US006081924A

United States Patent [19]

Ott

[11] Patent Number: 6,081,924

[45] Date of Patent: Jul. 4, 2000

[54] WEIGHTED TRAINING VEST

[76] Inventor: Patrick M. Ott, 534 Lincoln St., Erie, Pa. 16505

[21] Appl. No.: 08/957,658

[22] Filed: Oct. 24, 1997

[51] Int. Cl.[7] ..... A41D 1/04

[52] U.S. Cl. ..... 2/102; 2/69; 482/105; 482/120

[58] Field of Search ..... 2/102, 69, 94, 2/92, 455, 456, 463, 467, 2.5, 80, 48, 51, 93, 85, 105, 106, 74; 482/117, 119, 70, 105, 120

[56] References Cited

U.S. PATENT DOCUMENTS

| | | | |
|---|---|---|---|
| 4,382,302 | 5/1983 | Watson . | |
| 4,394,012 | 7/1983 | Egbert et al. . | |
| 4,602,387 | 7/1986 | Zakrzewski . | |
| 4,658,442 | 4/1987 | Tomlinson et al. . | |
| 5,144,694 | 9/1992 | Conrad Da oud . | |
| 5,146,625 | 9/1992 | Steele et al. | 2/102 |
| 5,361,412 | 11/1994 | Perry | 2/69 |
| 5,495,621 | 3/1996 | Kibbee | 2/102 X |
| 5,754,982 | 5/1998 | Gainer | 2/102 X |

OTHER PUBLICATIONS

Eastbay Sports Catalog—p. 28, "E–Finity Resistance Training Vest", Jan. 1996.

*Primary Examiner*—Gloria Hale
*Attorney, Agent, or Firm*—Howson and Howson

[57] ABSTRACT

A weighted vest capable of comfortably conforming to the body of the wearer. A top loaded vest is provided which extends over the wearer's thorax but terminates entirely above the wearer's abdomen so that full body movement is permitted and breathing is not restricted. Stretchable shoulder harnesses, or straps, are utilized so that the vest is supported comfortable on the shoulders of the wearer and so that the vest can conform to the body during various full range body movements. A pair of securement straps gird the wearer's chest to ensure that the weights and vest do not bounce or shift during exercise.

17 Claims, 5 Drawing Sheets

WEIGHTED TRAINING VEST

FIELD OF THE INVENTION

The present invention relates to a vest which can be worn by an individual during weight resistance training, and more particularly, the present invention relates to a weighted training vest which is comfortable to wear and which permits a full range of body movements.

BACKGROUND OF THE INVENTION

Vests capable of securing weights to a person's torso during an exercise workout are known in the art. The typical vest fits around the torso of the wearer and is supported by the wearer's shoulders. Such a vest includes means for securing the vest to the wearer and means for securing weights, or weight packets, to the vest. For example, see the weighted vests disclosed in U.S. Pat. Nos. 4,382,302 issued to Watson; 4,394,012 issued to Egbert et al.; 4,602,387 issued to Zakrzewski; 4,658,442 issued to Tomlinson et al.; and 5,144,694 issued to Conrad.

Weighted vests are particularly useful if they can be comfortably worn for extending periods of time during various types of exercise, for example, running, aerobics, exercising on a treadmill or stair-stepper, or participating in sports. However, if the weighted vest is not comfortable, or if restricts movement, significant use of the weighted vest may be limited to only a few types of exercises requiring only a minimum of movement for a short duration. For example, vests which extend to about the waistline of the wearer tend to interfere with the full movement of the wearer's abdomen and may prevent normal breathing. Weights carried by the vests which are not tightly secured to the wearer tend to experience a bouncing, or shifting, affect which provides discomfort to the wearer and prevents normal movement of the wearer. Additionally, since the vests are supported by the shoulders of the wearer, the shoulder harnesses of the vest which engage the shoulder can gauge or rub the wearer's shoulder causing discomfort and limiting frequency and duration of use of the vest.

Although various ones of the aforementioned and known weighted training vests may be satisfactory for their intended purposes, there is a need for an improved weighted training vest which provides optimal comfort to the wearer and which permits full body movement so that the vest can be frequently worn for extended periods of various exercises which require unrestricted movement of the wearer's abdomen, neck, shoulder and arms. In addition, the vest should be fully adjustable so that a single vest size can comfortably fit a range of male and female body sizes.

OBJECTS OF THE INVENTION

With the foregoing in mind, a primary object of the present invention is to provide a weighted training vest which is comfortable to wear and which permits a full range of body movements.

Another object of the present invention is to provide a weighted training vest which can be securely fastened to the wearer's chest and which does not inhibit movement of the abdomen or restrict normal breathing.

A further object of the present invention is to provide a weighted training vest having shoulder harnesses, or straps, which engage the wearer's shoulder in a comfortable manner permitting frequent and prolonged use of the weighted vest.

A further object of the present invention is to provide a weighted training vest which permits full body workouts for conditioning the upper body along with the legs.

A still further object of the present invention is to provide a weighted training vest which is readily put on, adjusted by, and removed from the wearer in a minimum of time requiring a minimum of effort.

SUMMARY OF THE INVENTION

More specifically, the present invention provides a vest which is for use by a wearer during weight resistance training and which includes a front vest panel connected to a rear vest panel by a pair of separate spaced-apart shoulder straps. The shoulder straps are made of a different material than the front and rear vest panels, are stretchable, and are shaped to comfortably engage the wearer's shoulder. Each of the front and rear vest panels have a lower end opposite the shoulder straps and at least one upwardly opening pocket for holding at least one weight. The lower ends of the front and rear vest panels are adjustably securable around the wearer's chest such that, when the vest is worn by the wearer, the lower ends terminate a spaced vertical distance above the wearer's abdomen.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
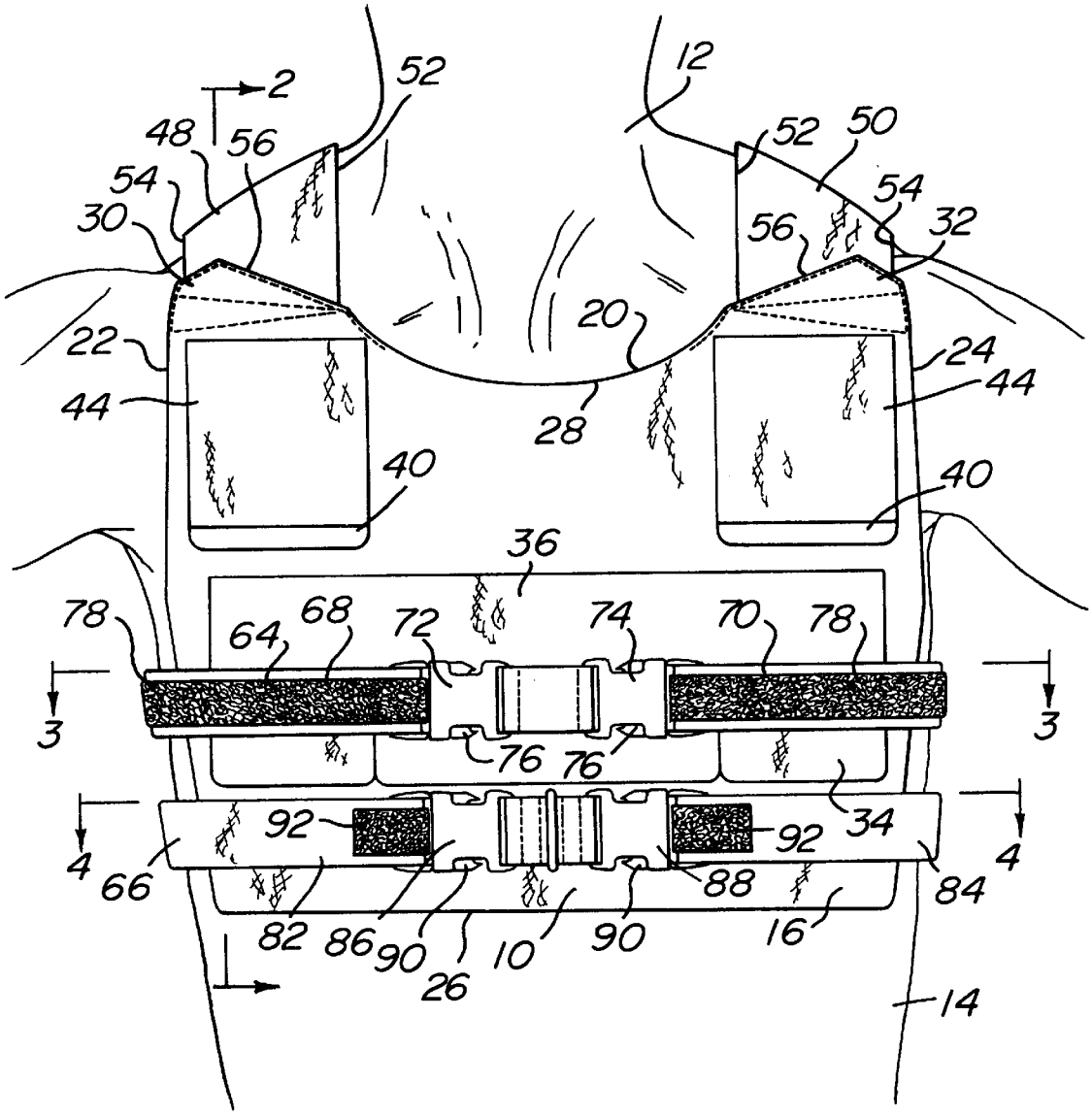
FIG. 1 is a front elevational view of a person wearing a weighted training vest embodying the present invention.

As illustrated in FIG. 1, the vest 10 of the present invention is intended to be worn on the chest of the wearer 12. Unlike many other known vests which extend over at least a portion of the wearer's abdomen 14, the vest 10 is specifically designed to extend over only the wearer's thorax and terminate a spaced vertical distance above the wearer's abdomen. Thus, the vest 10 permits full bending and twisting movement of the wearer's abdomen during weight resistance training and does not interfere with the wearer's ability to breath.

The vest 10 includes separate front and rear vest panels, 16 and 116, respectively. As best illustrated in FIG. 1, the perimeter of the front vest panel 16 is defined by an upper end 20, two opposite side edges 22 and 24, and a lower end 26. The upper end 20 includes a neck contour edge 28 and a pair of shoulder strap connecting portions 30 and 32. The rear vest panel 116 is substantially identical to the front vest panel 16 and has: an upper end 120, two opposite side edges 122 and 124, a lower end 126, a neck contour edge 128, and a pair of shoulder strap connecting portions 130 and 132. Each of the front and rear vest panels, 16 and 116, is essentially continuous between upper and lower ends and between side edges; thus, as illustrated, the front and rear panels 16 and 116 provide a flap-jacket type of vest.

Figure 3:
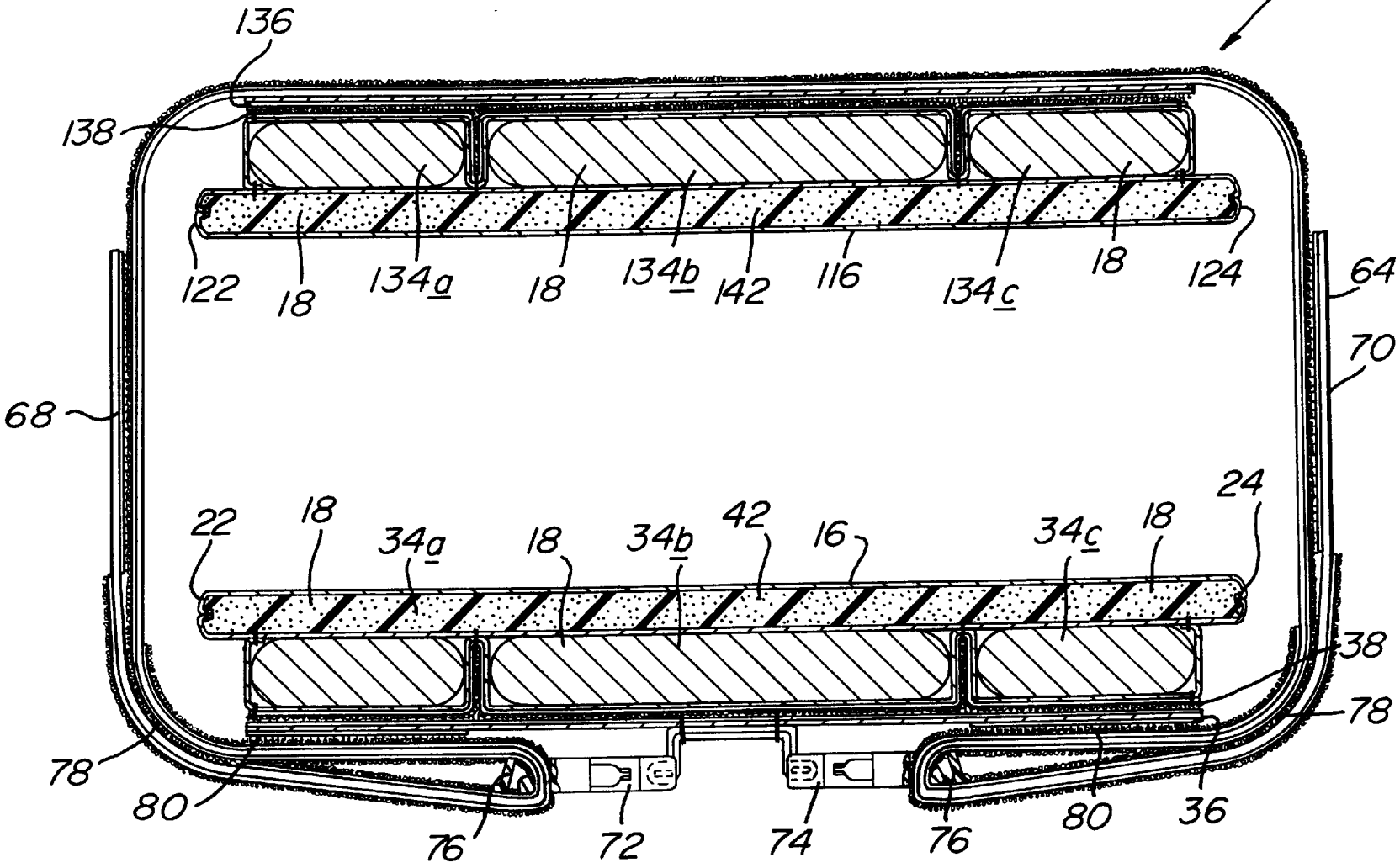
FIG. 3 is a horizontally-oriented cross-sectional view of the weighted training vest illustrated in FIG. 1, the view taken along the line 3—3.

Each of the vest panels, 16 and 116, are capable of holding various combinations of weight packets 18 in a secure manner so that when the vest 10 is worn, a pre-determined amount of weight resistance is provided to the wearer. To this end, each of the vest panels 16 and 116, has a pocket, 34 and 134, respectively, which preferably extends substantially the entire horizontal extent of the respective vest panel, 16 or 116, between the opposite side edges, 22 and 24, or 122 and 124. As best illustrated in FIG. 3, the pockets, 34 and 134, have three varying-sized, separate, upwardly-opening compartments, 34*a,* 34*b* and 34*c,* and, 134*a,* 134*b* and 134*c,* respectively, for holding separate weight packets 18. Preferably, the middle located compartments, 34*b* and 134*b,* are sized to receive two five pound weight packets, while the remaining compartments are sized to each hold one five pound weight packet.

Figure 2:
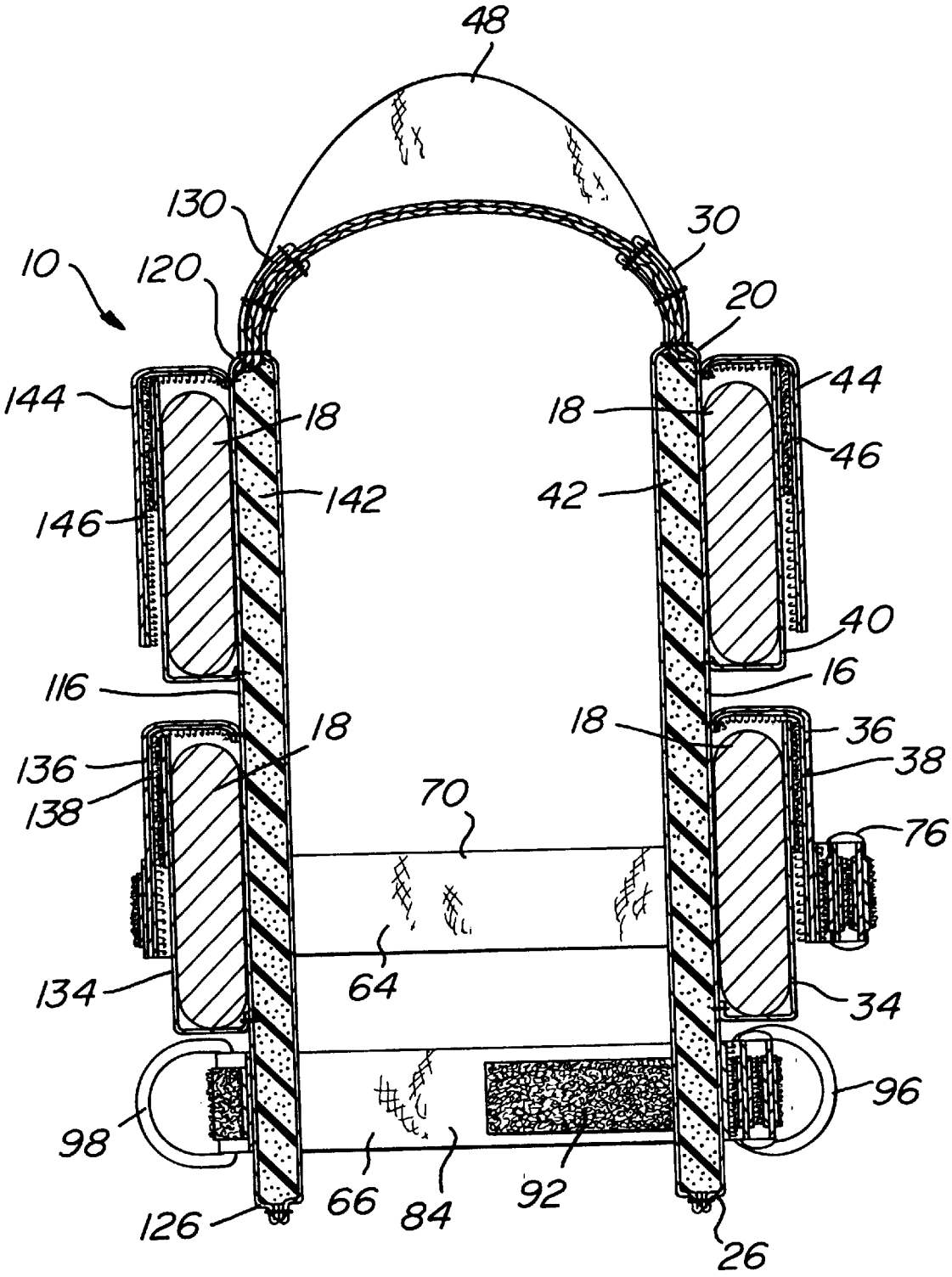
FIG. 2 is a vertically-oriented cross-sectional view of the weighted training vest illustrated in FIG. 1, the view taken along the line 2—2.

A single closure flap 36 extends substantially the entire horizontal extent of the front vest panel 16 and is used to securely lock the weight packets 18 in the pocket compartments 34*a,* 34*b* and 34*c*. Likewise, a single closure flap 136 extends substantially the entire horizontal extent of the rear vest panel 116 and is used to securely lock the weight packets 18 in the pocket compartments 134*a,* 134*b* and 134*c*. As best illustrated in FIG. 2, the closure flap 36 extends from the front vest panel 16 directly above the pocket 34 and can be extended over the pocket 34 to secure the weight packets 18 within the pocket 34. Likewise, the closure flap 136 extends from the rear vest panel 116 directly above the pocket 134 and can be extended over the pocket 134 to secure the weight packets 18 within the pocket 134. The confronting surfaces of the pockets, 34 and 134, and the closure flaps 36 and 136, are preferably provided with cooperating hook and loop type VELCRO fasteners 38 to ensure closure of the pockets and to prevent movement of the weights during exercise.

Figure 4:
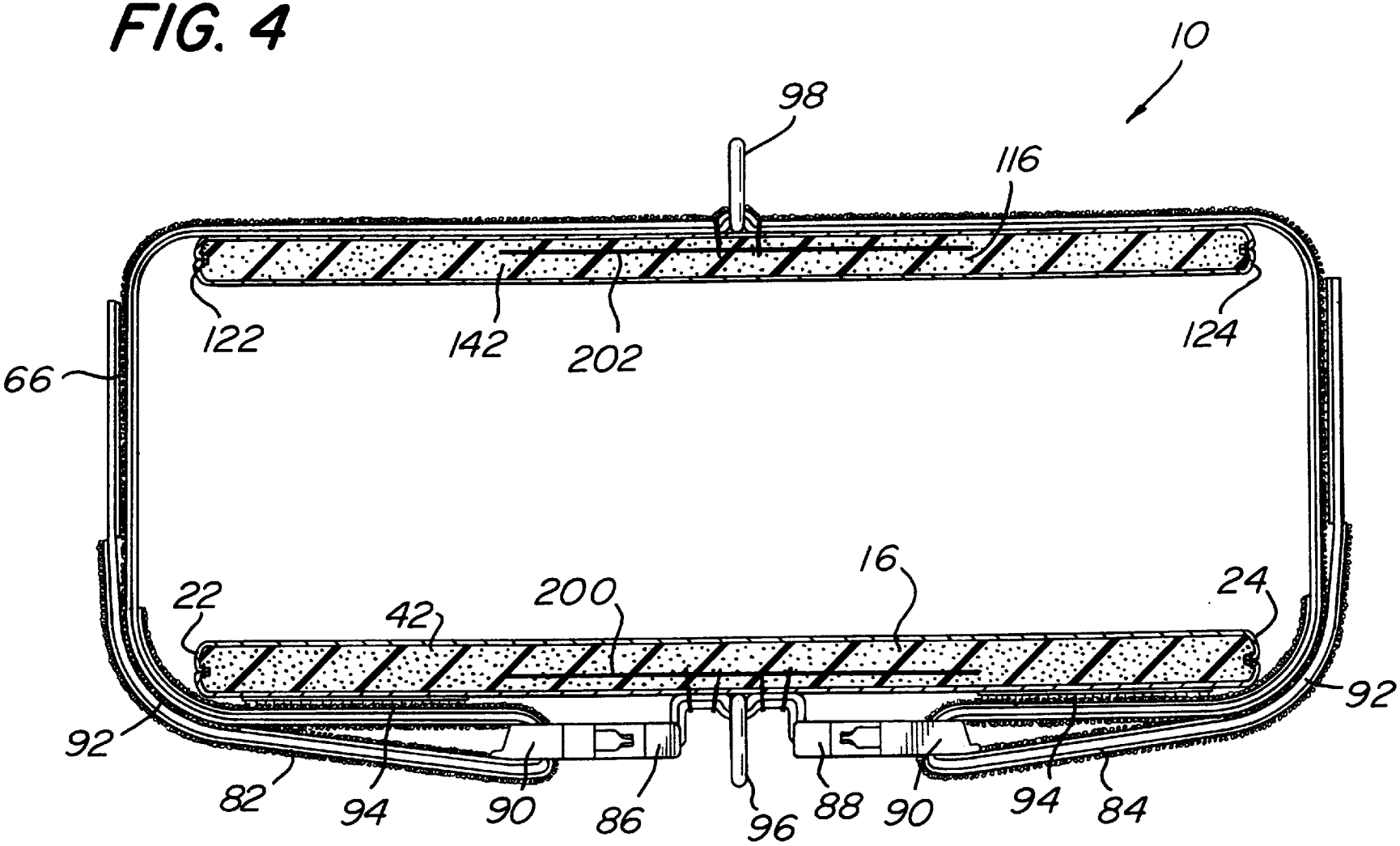
FIG. 4 is a horizontally-oriented cross-sectional view of the weighted training vest illustrated in FIG. 1, the view taken along the line 4—4.

Both the front and rear vest panels, 16 and 116, can be provided with additional pockets, 40 and 140, so that additional weight packets 18 can be affixed to the vest 10. For instance, as illustrated in FIG. 1, the front vest panel 16 has a pair of spaced-apart upper pockets 40 located between the pocket 34 and each shoulder strap connection portion 30 and 32. Each of the pockets 40 and 140 have individual closure flaps, 44 and 144, with cooperating hook and loop type VELCRO fasteners 46 to secure the weight packets in the pockets, 40 and 140. Also, as illustrated in FIGS. 2–4, both the front and rear vest panels have an enclosed layer of padding, 42 and 142, so that the weight packets 18 do not provide discomfort to the wearer. The padding 42 and 142 are stitched to the shoulder strap connecting portions, 30, 32, 130 and 132 at the upper ends of the vest panels by stitches 62 illustrated in FIG. 5 so that the padding remains evenly distributed throughout the vest panels.

The front and rear vest panels 16 and 116 are permanently connected by a pair of spaced-apart shoulder straps, or harnesses, 48 and 50. Shoulder strap 48 extends between and is preferably stitched to the shoulder strap connecting portion 30 of the front vest panel 16 and the shoulder strap connecting portion 130 of the rear vest panel 116, and the shoulder strap 50 extends between and is preferably stitched to the shoulder strap connecting portion 32 of the front vest panel 16 and the shoulder strap connecting portion 132 of the rear vest panel 116.

The shoulder straps 48 and 50 are specifically designed to comfortably engage the shoulders of the wearer while permitting a full range of body motion. To this end, the shoulder straps, 48 and 50, are made from a different material than the remaining vest in that the shoulder straps are made from a stretchable fabric material, for instance, multi-ply nylon. Preferably, the shoulder straps are stretchable in a direction "A", illustrated in FIG. 5, extending from one vest panel to the other vest panel so that the vest 10 can continuously conform to the shape of the body of the wearer during various movements of the shoulders, arms and neck of the wearer.

Figure 5:
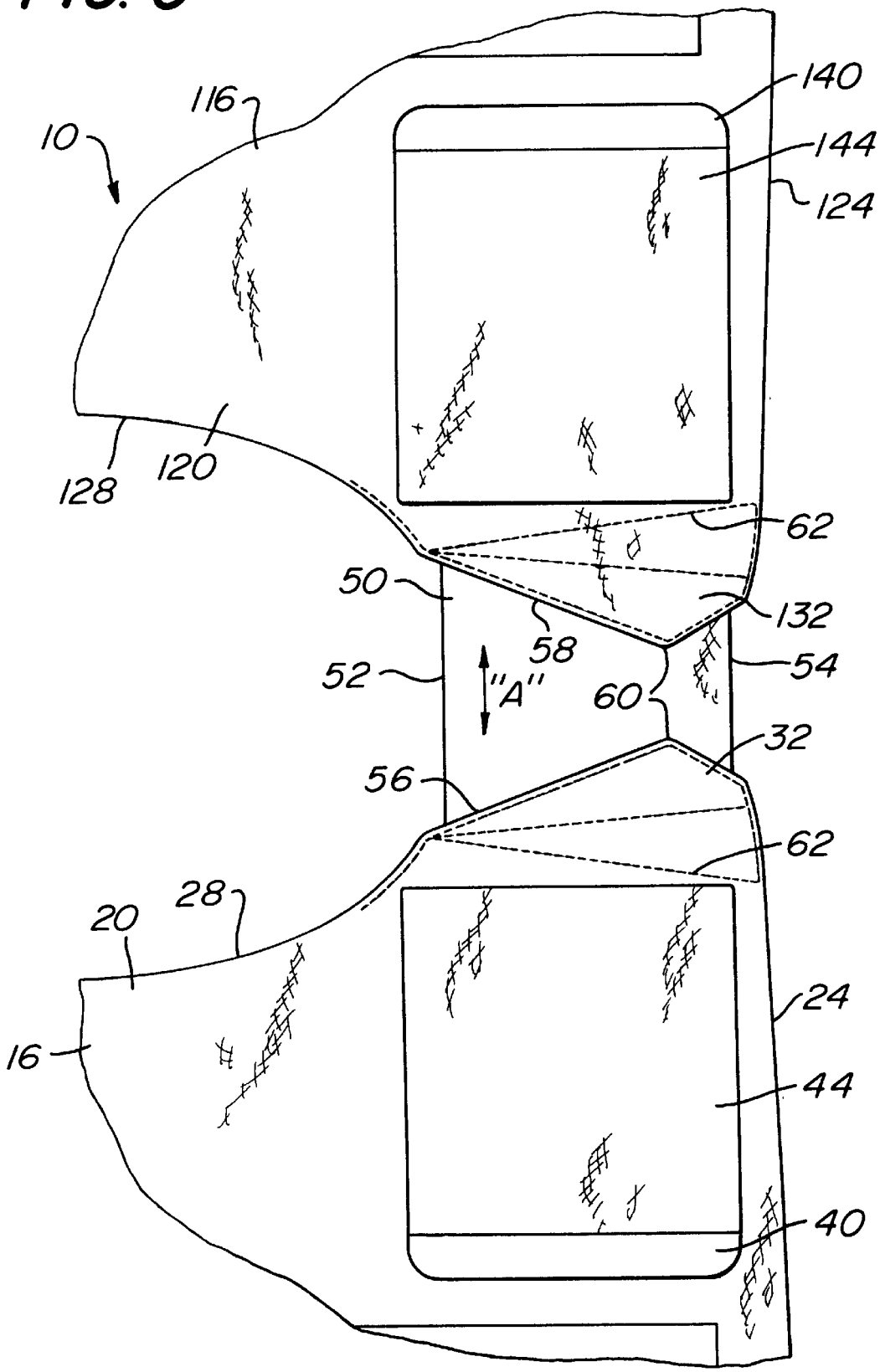
FIG. 5 is a top plan view of a shoulder strap which extends between and connects front and rear vest panels.

The specific shape of the identical shoulder straps, 48 and 50, between the front and rear vest panels, 16 and 116, is also important in providing comfort and in permitting a wide range of movement. To this end, as illustrated in FIG. 5, shoulder strap 50 has an inner edge 52 parallel to an outer edge 54, a front edge 56 defined by said shoulder strap connecting portion 32, and a rear edge 58 defined by said shoulder strap connecting portion 132. Preferably, the inner edge 52 is longer than the outer edge 54, and the front and rear edges, 56 and 58, are mirror images of one another and taper toward one another adjacent the inner edge 52 and the outer edge 54 toward an intermediate location 60. Preferably, the location 60 is closer to the outer edge 54 than to the inner edge 52. The resulting skewed hour glass shape of the stretchable shoulder strap closely follows the natural contour of the wearer's shoulder so that the shoulder straps conform to the shoulders in a comfortable manner and evenly distribute and support the load created by the weights 18.

The front and rear vest panels, 16 and 116, are adjustably secured to the wearer preferably by a pair of securement straps, 64 and 66, which both substantially gird the wearer's chest below the wearer's armpits. As best illustrated in FIG. 3, securement strap 64 is capable of extending across the pockets 34 and 134 and the closure flaps 36 and 136 to hold the weight packets 18 within the pockets, 34 and 134, snug to the body of the wearer. As best illustrated in FIG. 4, securement strap 66 extends below the pockets 34 and 134 and secures the lower ends, 26 and 126, of the front and rear vest panels, 16 and 116, to the chest of the wearer. The combination and specific locations of the two securement straps, 64 and 66, prevent bouncing and shifting of the weight packets 18 and the vest 10 relative to the chest of the wearer.

As illustrated in FIG. 3, securement strap 64 is permanently attached along the entire horizontal length of the closure flap 136 located on the rear vest panel 116 and has a pair of free ends 68 and 70. The ends 68 and 70 can be extended in a forward direction around the wearer's chest and releasably connect to a pair of fasteners 72 and 74 located on the closure flap 36 on the front vest panel 16. Each end, 68 and 70, have a clasp 76 which, preferably, snap fits into engagement with the fasteners 72 and 74 and which permits adjustment of the length of the securement strap 64. Accordingly, the strap ends 68 and 70 can extend through the clasps 76 and be reversely turned a needed extent in order for the securement strap 64 to tightly secure the vest 10 to the wearer's chest. In addition, both sides of the securement strap 64 can have cooperating hook and loop type VELCRO fasteners 78 so that the reversely turned portions of the ends 68 and 70 are secured to the forward extending portions of the ends 68 and 70. The closure flap 36 also has cooperating hook and loop type VELCRO fasteners 80 which secure the forward extending portions of the ends 68 and 70 to the closure flap 36 adjacent the fasteners 72 and 74.

As illustrated in FIG. 4, securement strap 66 is permanently attached along the entire horizontal length of the lower end 126 of the rear vest panel 116 below the pocket 134 and has a pair of free ends 82 and 84. The ends 82 and 84 can be extended in a forward direction around the wearer's chest and releasably connect to a pair of fasteners 86 and 88 located on the lower end 26 of the front vest panel 16 below the pocket 34. Each end, 82 and 84, have a clasp 90 which, preferably, snap fits into engagement with the fasteners 86 and 88 and which permits adjustment of the length of the securement strap 66. Accordingly, the strap ends 82 and 84 can extend through the clasps 90 and be reversely turned a needed extent in order for the securement strap 66 to tightly secure the vest 10 to the wearer's chest. In addition, both sides of the securement strap 66 can have cooperating hook and loop type VELCRO fasteners 92 so that the reversely turned portions of the ends 82 and 84 are secured to the forward extending portions of the ends 82 and 84. The lower end 26 also has cooperating hook and loop type VELCRO fasteners 94 which secure the forward extending portions of the ends 82 and 84 to the lower end 26 adjacent the fasteners 86 and 88.

The vest 10 is also provided with a pair of outwardly extending metal loops 96 and 98 which are intended for use in certain exercises so that additional weight resistance apparatus can be hooked to the vest. For instance, stretchable cording (not shown) can be hooked to the vest via one, or both, of the metal loops, 96 and 98, and the wearer can exercise by running toward the direction of pull generated by the stretchable cording, or by running away from, or by running lateral to the direction of pull. As best illustrated in FIG. 4, the loops, 96 and 98, are secured to the lower ends, 26 and 126, of the front and rear vest panels, 16 and 116 below the pockets 34 and 134. The loops 96 and 98 are permanently stitched to the vest, and the stitching is reinforced by reinforcement straps, 200 and 202, which are located internally of the vest panels adjacent the locations of the loops 96 and 98. See FIG. 4.

In use, the pockets of the vest can be inserted with any combination of weight packets desired. After the weight packets are in place, the closure flaps are positioned to close the pockets, and the vest is placed over the head of the wearer so that the front vest panel 16 extends over the chest of the wearer, the rear vest panel 116 extends over the back of the wearer, and the shoulder straps, 48 and 50, engage the shoulders of the wearer. The clasps 76 of the ends 68 and 70 of the securement strap 64 are extended forward around the chest of the wearer and are locked into the fasteners 72 and 74. The ends 68 and 70 are reversely turned a sufficient distance until the vest is snug against the wearer. The clasps 90 of the ends 82 and 84 of the securement strap 66 are extended forward around the chest of the wearer and are locked into the fasteners 86 and 88. The ends 82 and 84 are reversely turned a sufficient distance until the vest is snug against the wearer. The combination of the snap-fitting fasteners and hook and loop type VELCRO fasteners ensure that the securement straps 64 and 66 will remain in place even during a vigorous workout.

Many alternatives to the vest construction could be utilized. For instance, the size, shape and location of the pockets can be modified and can be adapted to receive weights of different size and weight. The weight packets can be solid weights or sealed bags of heavy particle material, such as lead. The shoulder straps can be made of different types of stretchable material, and the securement straps can be fastened using different types of fasteners.

While a preferred vest configuration has been described in detail, various modifications, alterations, and changes may be made without departing from the spirit and scope of the weighted training vest according to the present invention as defined in the appended claims.

I claim:

1. A vest worn by a wearer for weight resistance training, comprising a separate front vest panel connected to a separate rear vest panel by a pair of separate spaced-apart shoulder straps, said shoulder straps being made of a different material than said front and rear vest panels, being shaped to comfortably engage the wearer's shoulder, and being stretchable, each of said front and rear vest panels having a lower end opposite said shoulder straps and at least one upwardly opening pocket for holding at least one weight, said lower ends of said front and rear vest panels being adjustably securable around the wearer's chest such that, when the vest is worn by the wearer, said lower ends terminate a spaced vertical distance above the wearer's abdomen, wherein the shape of each of said shoulder straps is defined by an inner edge adjacent said wearer's neck, an outer edge located adjacent an outer portion of the wearer's shoulder, a front edge adjacent said front vest panel, and a rear edge adjacent said rear vest panel, wherein said shoulder strap material is stretchable in a direction extending from said front edge to said back edge, and wherein said inner edge of each of said shoulder straps extends parallel to said outer edge and has a greater length than said outer edge.

2. The vest according to claim 1, wherein the front and rear edges of each of said shoulder straps are a mirror image of one another, said front and rear edges taper toward one another in an inner portion of each of said shoulder straps and then taper outwardly away from one another in an outer portion of each of said shoulder straps.

3. The vest according to claim 2, wherein the width of said inner portion of each of said shoulder straps is greater than the width of said outer portion of each of said shoulder straps.

4. A vest worn by a wearer for weight resistance training, comprising a separate front vest panel connected to a separate rear vest panel by a pair of separate spaced-apart shoulder straps, said shoulder straps being made of a different material than said front and rear vest panels, being shaped to comfortably engage the wearer's shoulder, and being stretchable, each of said front and rear vest panels having a lower end opposite said shoulder straps and at least one upwardly opening pocket for holding at least one weight, said lower ends of said front and rear vest panels being adjustably securable around the wearer's chest such that, when the vest is worn by the wearer, said lower ends terminate a spaced vertical distance above the wearer's abdomen, wherein said at least one pocket on said front vest panel extends substantially the entire horizontal extent of said front vest panel and has a closure flap extending from said front vest panel above said at least one pocket which cooperatively engages said at least one pocket to lockingly secure at least one weight therein; and wherein said at least one pocket on said rear vest panel extends substantially the entire horizontal extent of said rear vest panel and has a closure flap extending from said rear vest panel above said at least one pocket which cooperatively engages said at least one pocket to lockingly secure at least one weight therein.

5. The vest according to claim 4, further comprising an upper securement belt and a lower securement belt for adjustably securing said lower ends of said front and rear vest panels to the wearer's chest.

6. The vest according to claim 5, wherein said upper securement belt substantially girds the wearer's chest, the front vest panel, and the rear vest panel such that the upper securement belt extends over said at least one pocket and closure flap of each of said front and rear vest panels; and wherein said lower securement belt substantially girds the wearer's chest, the front vest panel, and the rear vest panel such that the lower securement belt extends a spaced distance below said at least one pocket of each of said front and rear vest panels.

7. The vest according to claim 6, wherein said upper securement belt is permanently attached to said closure flap on said rear vest panel and has a pair of ends which releasably connect to at least one fastener located on said closure flap on said front vest panel in a manner which permits adjustment of the girding length of said upper securement belt around the wearer's chest; and wherein said lower securement belt is permanently attached to said rear vest panel and has a pair of ends which releasably connect to at least one fastener located on said front vest panel in a manner which permits adjustment of the girding length of said lower securement belt around the wearer's chest.

8. The vest according to claim 7, wherein said upper securement belt is also releasably secured to said closure flap on said front vest panel adjacent said at least one fastener on said front vest panel closure flap by cooperatively engaging hook and loop fasteners located on said upper securement belt and said front vest panel closure flap; and wherein said lower securement belt is also releasably secured to said front vest panel adjacent said at least one fastener on said front vest panel by cooperatively engaging hook and loop fasteners located on said lower securement belt and said front vest panel.

9. The vest according to claim 7, further comprising an outwardly extending metal loop permanently attached to said front vest panel below said at least one front vest panel pocket and an outwardly extending metal loop permanently attached to said rear vest panel below said at least one rear vest panel pocket.

10. The vest according to claim 7, further comprising additional pockets on said front and rear vest panels, each additional pocket capable of holding additional weights and having closure flaps.

11. The vest according to claim 7, wherein said front and rear vest panels are each of one piece construction, have a contoured neck line, and have internal padding.

12. A vest capable of being worn by a wearer for participation in weight resistance training, comprising:

a one-piece front vest panel having an upper and a lower end, when worn said front vest panel extending over a portion of the wearer's chest with said lower end terminating on the wearer's chest a spaced vertical distance above the wearer's abdomen;

a one-piece rear vest panel having an upper and a lower end, when worn said rear vest panel extending over a portion of the wearer's upper back with said lower end terminating on the wearer's back a spaced distance above the wearer's abdomen;

a pair of shoulder straps for engaging the wearer's shoulders, said shoulder straps extending between and permanently connecting said front and rear vest panels at said upper ends, each said shoulder strap being made of stretchable material and having a shape between said upper ends of said front and rear vest panels which corresponds to the contour of the wearer's shoulders;

at least one pocket having a closure flap located on each of said front and back vest panels for holding weights; and a pair of securement belts permanently attached to said rear vest panel and releasably connectable to said front vest panel, said securement belts substantially gird the wearer's chest and are capable of tightly securing said lower ends of said front and rear vest panels to said wearer;

wherein the shape of each of said shoulder straps between said upper ends of said front and rear vest panels is defined by an inner edge adjacent said wearer's neck, an outer edge spaced from and parallel to said inner edge; a front edge extending between said inner and outer edges and adjacent said front vest panel, and a rear edge extending between said inner and outer edges and adjacent said rear vest panel; and wherein said inner edge of each of said shoulder straps has a greater length than said outer edge.

13. The vest according to claim 12, wherein said front and rear edges of each of said shoulder straps are a mirror image of one another and taper toward one another in an inner portion of each of said shoulder straps and then taper outwardly away from one another in an outer portion of each of said shoulder straps; and wherein the width of said inner portion of each of said shoulder straps is greater than the width of said outer portion of each of said shoulder straps.

14. The vest according to claim 13, wherein said at least one pocket and closure flap on said front vest panel extends substantially the entire horizontal extent of said front vest panel and said at least one pocket and closure flap on said rear vest panel extends substantially the entire horizontal extent of said rear vest panel; and wherein one of said securement belts extends over said at least one pocket and closure flap of each of said front and rear vest panels and the other of said securement belts extends around the wearer's chest below said at least one pocket of each of said front and rear vest panels.

15. The vest according to claim 14, wherein said securement belt which extends over said pockets and flaps is permanently attached to said closure flap on said rear vest panel and has a pair of ends which releasably snap fit to a pair of fasteners located on said closure flap on said front vest panel in a manner which permits adjustment of the girding length of said securement belt; and wherein said securement belt which extends below said pockets is permanently attached to said rear vest panel below said rear vest panel pocket and has a pair of ends which releasably snap-fit to a pair of fasteners located on said front vest panel below said front vest panel pocket in a manner which permits adjustment of the girding length of said securement belt.

16. A vest worn by a wearer for participating in weight resistance training, comprising:

a one-piece front vest panel having a lower end and an upper end, said upper end having a contoured neck line extending between a pair of shoulder strap connecting portions and said lower end terminating on the wearer's chest a spaced vertical distance above the wearer's abdomen;

a one-piece rear vest panel having a lower end and an upper end, said upper end of said rear vest panel having a contoured neck line extending between a pair of shoulder strap connecting portions;

a pair of shoulder straps made of stretchable material, each shoulder strap being connected to, extending between, and spacing apart one of said shoulder strap connecting portions of said front vest panel and one of said shoulder strap connecting portions of said rear vest panel;

said front vest panel having at least one upwardly-open weight-securing pocket with a closure flap for securely closing said front vest panel pocket, said front vest panel pocket and closure flap extending substantially the entire horizontal extent of said front vest panel;

said rear vest panel having at least one upwardly-open weight-securing pocket with a closure flap for securely closing said at least one rear vest panel pocket, said rear vest panel pocket and closure flap extending substantially the entire horizontal extent of said rear vest panel;

a first belt permanently attached to said rear vest panel closure flap and having a pair of ends which releasably connect to a pair of fasteners on said front vest panel closure flap to substantially gird the wearer's chest over said front and rear vest panel pockets to tightly secure said front and rear vest panels to said wearer; and a second belt permanently attached to said rear vest panel below said rear vest panel pocket and having a pair of ends which releasably connect to a pair of fasteners on said front vest panel below said front vest panel pocket to substantially gird the wearer's chest directly below said front and rear vest panel pockets to tightly secure said front and rear vest panels to said wearer.

17. The vest according to claim 16, wherein the shape of each of said shoulder strap connecting portions of said front and rear vest panels is triangular so that the length of said shoulder strap between opposing front and rear shoulder strap connecting portions narrows in a first shoulder strap portion adjacent the wearer's neck and then expands in a second shoulder strap portion remote from the wearer's neck.

* * * * *